US010975863B2

(12) United States Patent
Kanatani

(10) Patent No.: US 10,975,863 B2
(45) Date of Patent: Apr. 13, 2021

(54) GEAR PUMP OR MOTOR WITH FEATURES FOR DETERMINING IF ASSEMBLED CORRECTLY

(71) Applicant: SHIMADZU CORPORATION, Kyoto (JP)

(72) Inventor: Kenichi Kanatani, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/651,351

(22) PCT Filed: Oct. 13, 2017

(86) PCT No.: PCT/JP2017/037223
§ 371 (c)(1),
(2) Date: Mar. 27, 2020

(87) PCT Pub. No.: WO2019/073602
PCT Pub. Date: Apr. 18, 2019

(65) Prior Publication Data
US 2020/0232326 A1 Jul. 23, 2020

(51) Int. Cl.
*F04C 2/14* (2006.01)
*F01C 1/14* (2006.01)
(Continued)

(52) U.S. Cl.
CPC ..... *F04C 2/14* (2013.01); *F01C 1/14* (2013.01); *F03C 2/08* (2013.01); *F04C 2/18* (2013.01); *F04C 2230/60* (2013.01)

(58) Field of Classification Search
CPC ..... F01C 1/14; F03C 2/08; F04C 2/14; F04C 2/18; F04C 2230/60
See application file for complete search history.

(56) References Cited

U.S. PATENT DOCUMENTS 4,311,445 A * 1/1982 Eley ..... F04C 2/18 418/132

FOREIGN PATENT DOCUMENTS

JP 2007239621 9/2007
JP 2017150387 8/2017

OTHER PUBLICATIONS

"International Search Report (Form PCT/ISA/210) of PCT/JP2017/037223", dated Jan. 9, 2018, with English translation thereof, pp. 1-3.

(Continued)

*Primary Examiner* — Mary Davis
(74) *Attorney, Agent, or Firm* — JCIPRNET

(57) ABSTRACT

Provided is a gear pump or a motor provided with: a casing internally provided with a gear housing compartment in which a pair of gears are housed; a side plate interposed between the casing and the gears; and a gasket which is disposed on a non-slide surface, and which divides a space between the non-slide surface and the casing into a high pressure side and a low pressure side. The gear pump or the motor is configured such that, in order to discover early the mounting of the side plate in a wrong attitude, such as the upper and lower sides thereof being reversed or the high pressure portion side and the low pressure portion side being reversed, flow rate efficiency is decreased when the side plate is in an attitude other than a predetermined attitude, compared to when the side plate is in the predetermined attitude.

2 Claims, 6 Drawing Sheets

(51) Int. Cl.
*F04C 2/18* (2006.01)
*F03C 2/08* (2006.01)

(56) References Cited

OTHER PUBLICATIONS

Written Opinion of the International Searching Authourity (Form/ISA/237) of PCT/JP2017/037223, dated Jan. 9, 2018, with partial English translation thereof, p. 1-p. 4.
"Office Action of Japan Counterpart Application", dated Oct. 20, 2020, with English translation thereof, p. 1-p. 6.

* cited by examiner

GEAR PUMP OR MOTOR WITH FEATURES FOR DETERMINING IF ASSEMBLED CORRECTLY

CROSS-REFERENCE TO RELATED APPLICATION

This application is a 371 application of the international PCT application serial no. PCT/JP2017/037223, filed on Oct. 13, 2017. The entirety of the above-mentioned patent application is hereby incorporated by reference herein and made a part of this specification.

BACKGROUND

Technical Field

The invention relates to a gear pump or motor that sends out hydraulic fluid by using tooth spaces of a driving gear and a driven gear which form a pair of gears meshing with each other.

Description of Related Art

Conventionally, as shown in FIG. 1 and FIG. 6, a gear pump or motor is provided with a casing a side plate 6, and a gasket 8. The casing 1 has a gear housing compartment 11*a* inside that houses a pair of gears 2 and 3. The side plate 6 is interposed between the casing 1 and the gears 2 and 3. The gasket 8 is provided on a non-slide surface 6*b*, which is a surface on the opposite side of a slide surface 6*a*, and the slide surface 6*a* is a surface on a side of the side plate 6 facing the gears 2 and 3. The gasket 8 divides a space between the non-slide surface 6*b* and the casing 1 into a high pressure side and a low pressure side. For such a gear pump or motor, it is widely adopted to process the slide surface 6*a* of the side plate 6 in order to suppress the friction between the gears 2 and 3 and the side plate 6. If such a side plate 6 is mounted reversely, after delivery of the gear pump or motor, the decrease in slidability between the gears 2 and 3 and the side plate 6 may result in damage, or the strange noise generated from the gear pump or motor may resonate with the vehicle body of the vehicle equipped with the gear pump or motor and cause loud noise. Such problems may be overlooked during pre-delivery inspections.

In addition, in the side plate 6 of such a gear pump, a meshing area 6*p* is provided at a portion, corresponding to a meshing portion of the pair of gears 2 and 3, on the side plate 6, and the hydraulic fluid is prevented from leaking from the high pressure side to the low pressure side. This meshing area 6*p* is located closer to the low pressure portion in order to prevent the hydraulic fluid in the space defined by the side plate 6 and the teeth of the gears 2 and 3 from being compressed in the space and generating strange noise. If the high pressure portion side and the low pressure portion side of such a side plate 6 are mounted reversely, after delivery of the gear pump or motor, the strange noise generated by compression of the hydraulic fluid in the space defined by the side plate 6 and the teeth of the gears 2 and 3 may resonate with the vehicle body of the vehicle equipped with the gear pump or motor and cause loud noise. Such problems may be overlooked during pre-delivery inspections.

RELATED ART

Patent Document

Patent Document 1: Japanese Laid-Open No. 2007-239621

SUMMARY

Problems to be Solved

In view of the above, the invention makes it possible to discover early that the side plate is mounted in an incorrect attitude such as the side plate being reversed or the high pressure portion side and the low pressure portion side being reversed.

Means for Solving the Problems in order to solve the above problems, a gear pump or motor according to the invention has a configuration as described hereafter. That is, the gear pump or motor according to the invention includes: a casing having a gear housing compartment inside, which houses a pair of gears; a side plate interposed between the casing and the gears; and a gasket provided on a non-slide surface, which is a surface on an opposite side of a slide surface that is a surface on a side of the side plate facing the gears, and the gasket dividing a space between the non-slide surface and the casing into a high pressure side and a low pressure side. The gear pump or motor is configured such that, when the side plate is in an attitude other than a predetermined attitude, a flow rate efficiency is decreased to be lower than a flow rate efficiency when the side plate is in the predetermined attitude.

According to the above, since a trial operation before delivery is performed in a state of low flow rate efficiency when the side plate is not in the predetermined attitude, it is possible to recognize that the side plate is not inserted in the correct attitude through the decrease in flow rate efficiency. Therefore, it is possible to prevent the gear pump or motor from be delivered with the side plate inserted in an incorrect attitude.

As one of the specific forms for easily discovering that the side plate is inserted reversely, a meshing area is provided at a portion, corresponding to a meshing portion of the pair of gears, on the side plate, and the meshing area is larger on the slide surface than on the non-slide surface. According to the above, as the meshing area having a small area and located on the non-slide surface side faces the gears, the effect of sealing between the high pressure portion and the low pressure portion brought by the meshing area is reduced, which can lead to a decrease in flow rate efficiency.

As one of the specific forms for easily discovering that the high pressure portion side and the low pressure portion side of the side plate are mounted reversely, a protrusion in contact with the gear housing compartment is provided on a side part on a side, which is to be disposed on the high pressure side, of the side plate, and the side part is configured to contact the gear housing compartment only by the protrusion, and the protrusion is shorter than one pitch of the gears. According to the above, in the case where the high pressure portion side and the low pressure portion side of the side plate are mounted reversely, when the space between the teeth reaches the protrusion, the space on the high pressure side relative to the protrusion communicates with the space on the low pressure side relative to the protrusion, and the hydraulic fluid leaks from the high pressure portion side to the low pressure portion side, leading to a decrease in flow rate efficiency.

Effects

According to the invention, due to the decrease in the flow rate efficiency, it is possible to discover early that the side plate is mounted in an incorrect attitude such as the side plate being reversed or the high pressure portion side and the low pressure portion side being reversed.

DESCRIPTION OF THE EMBODIMENTS

Figure 2:
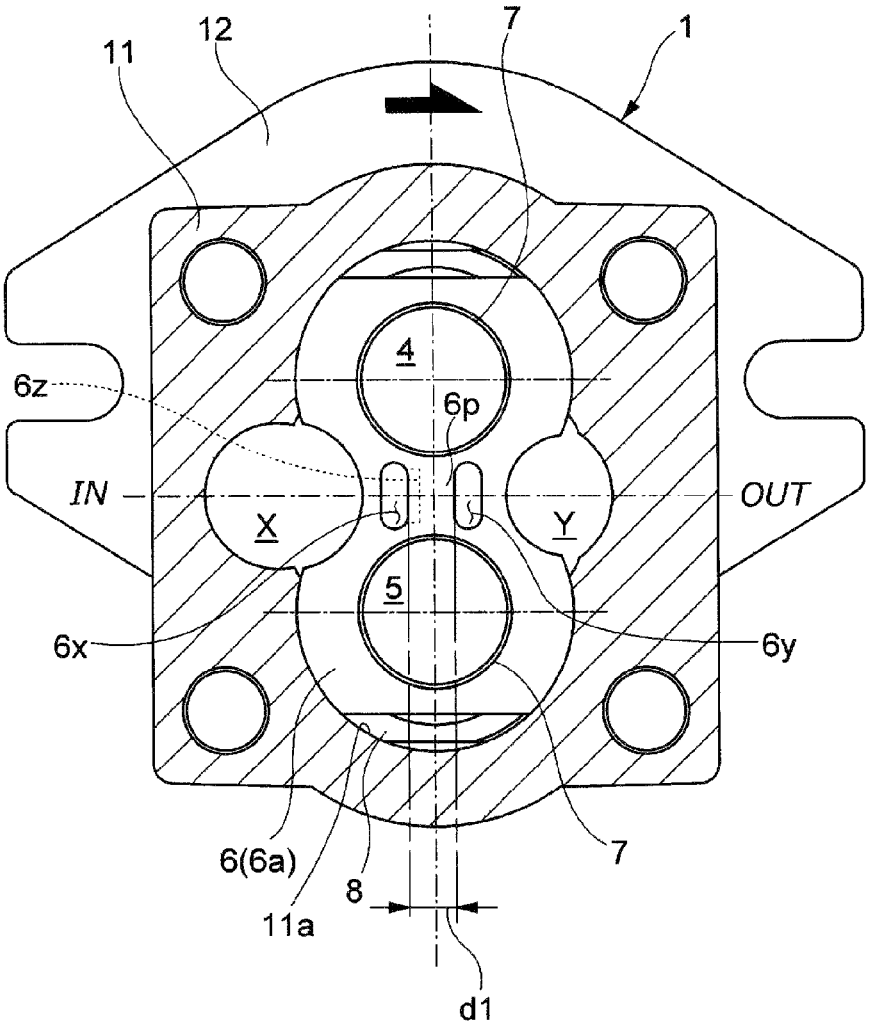
FIG. 2 is a cross-sectional view taken along the line A-A in FIG. 1.
Figure 3:
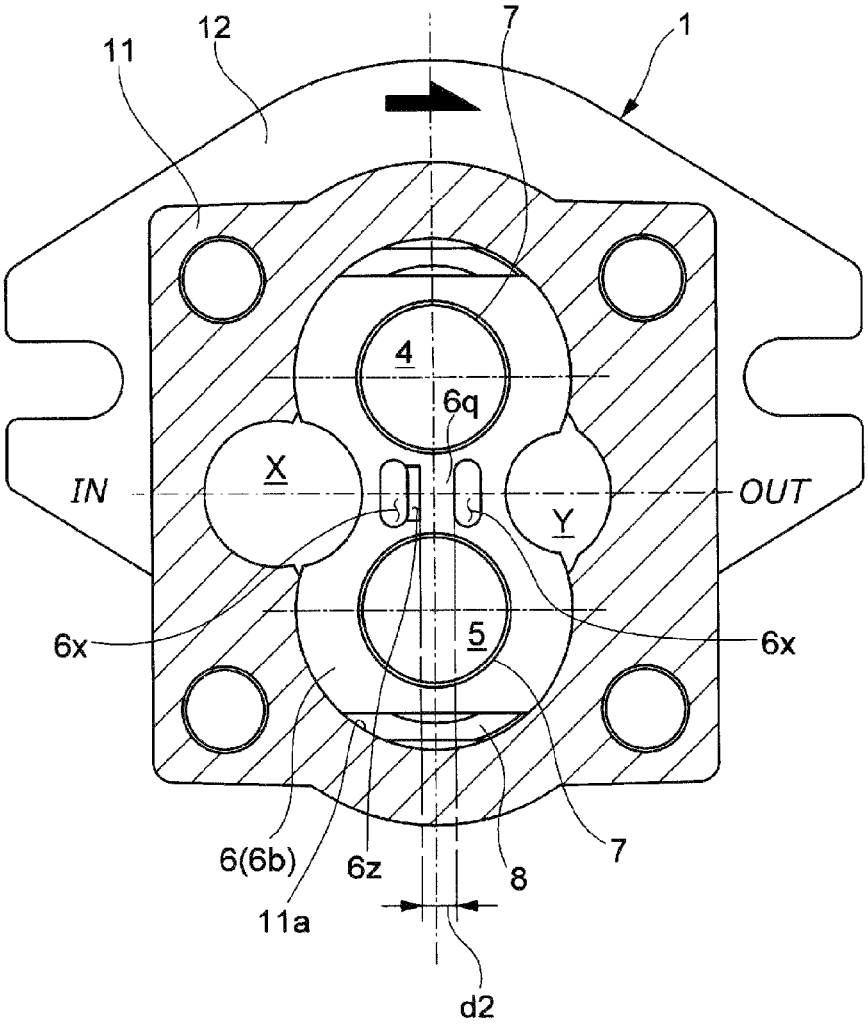
FIG. 3 is a cross-sectional view corresponding to FIG. 2 in a state where the side plate according to the embodiment is mounted reversely.

The first embodiment of the invention will be described hereafter with reference to FIG. 1 to FIG. 3.

Figure 1:
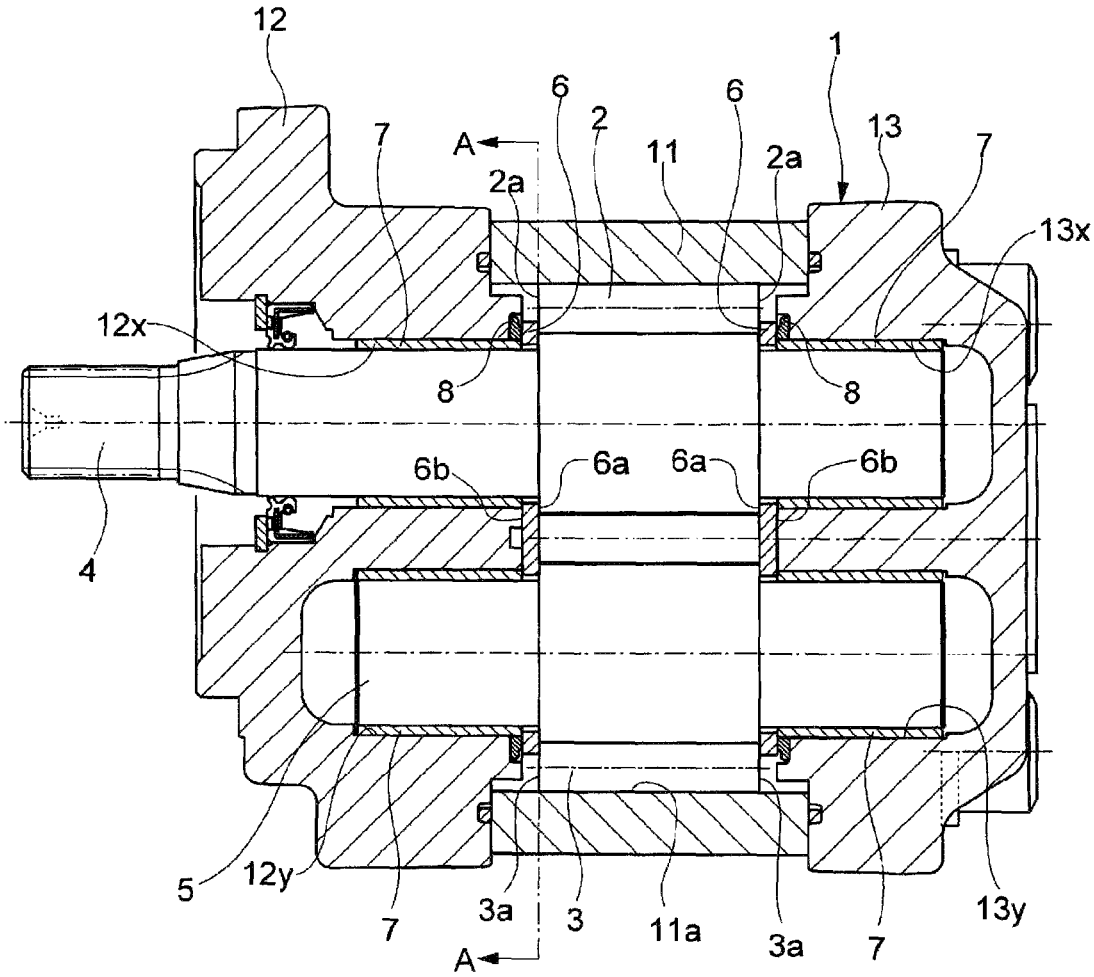
FIG. 1 is a schematic view showing the gear pump according to the first embodiment of the invention.

As shown in FIG. 1, the gear pump of the present embodiment mainly includes: a casing 1; an external gear pair; a driving shaft 4 and a driven shaft 5; a side plate 6; bushes 7; and a gasket 8, wherein the casing 1 formed by joining a body 11 having a gear housing compartment 11*a* inside; a front cover 12 closing the gear housing compartment 11*a* of the body 11 from the front; and a rear cover 13 that closes the gear housing compartment 11*a* of the body 11 from the rear, the external gear pair, that is, a driving gear 2 and a driven gear 3, housed and held inside the gear housing compartment 11*a* of the casing 1 and meshing with each other, the driving shaft 4 and the driven shaft 5 supporting the driving gear 2 and the driven gear 3 respectively, the side plate 6 in contact with side surfaces of the driving gear 2 and the driven gear 3 respectively, the bushes 7 which are bearing parts respectively disposed between inner surfaces of shaft holes 12*x*, 12*y*, 13*x*, and 13*y* of the casing 1 for respectively housing the driving shaft 4 and the driven shaft 5, and the driving shaft 4 and the driven shaft 5, the gasket 8 disposed between the side plate 6 and the casing 1.

Since the casing 1, the driving gear 2, the driven gear 3; the driving shaft 4, the driven shaft 5, and the bush 7 have the same configurations as those that have been used for this type of gear pump, detailed descriptions thereof are omitted.

As shown in FIG. 1, the side plate 6 is disposed at two positions so as to be brought into contact with two side surfaces 2*a* and 3*a* of the driving gear 2 and the driven gear 3 for respectively sealing the side surfaces 2*a* and 3*a* of the driving gear 2 and the driven gear 3. As shown in FIG. 2 and FIG. 3, among the outer peripheral edges of the side plate 6, the edges on the low pressure side (that is, the side of a suction port X) and the high pressure side (that is, the side of a discharge port Y) form a shape corresponding to the inner surface of the gear housing compartment 11*a*. In addition, a slide surface 6*a* of the side plate is processed so as to reduce the friction between the side plate 6 and the driving gear 2 or the driven gear 3. Then, in the present embodiment, the portion, corresponding to a meshing portion of the driving gear 2 and the driven gear 3, on the side plate 6 is configured as follows. At the part near the suction port X and the discharge port Y, a total of two communication holes 6*x* and 6*y* are provided for guiding the hydraulic fluid to the side opposite to the gears 2 and 3 beyond the side plate 6. The parts between these communication holes 6*x* and 6*y* are meshing areas 6*p* and 6*q* that are in a flat plate shape and face the meshing portion of the gears 2 and 3 in order to seal leakage of the hydraulic fluid from the high pressure side (the side of the discharge port Y) to the low pressure side (the suction port X).

Accordingly, in the present embodiment, the meshing area 6*p* on the side of the slide surface 6*a* is configured to be larger than the meshing area 6*q* on the side of the non-slide surface 6*b*. Specifically, as shown in FIG. 2 and FIG. 3, a bottomed groove 6*z* that opens on the side of the non-slide surface 6*b* is connected to an edge, on the opposite side of the suction port X, of the communication hole 6*x* on the low pressure side. That is, at the part where the bottomed groove 6*z* is formed, the surface on the side of the slide surface 6*a* is continuous with the surface of the adjacent part and forms the meshing area 6*p*, whereas the surface on the side of the non-slide surface 6*b* is the groove bottom of the bottomed groove 6*z* and does not constitute the meshing area 6*q*. Therefore, a width d1 of the meshing area 6*p* on the side of the slide surface 6*a* is larger than a width d2 of the meshing area 6*q* on the side of the non-slide surface 6*b*.In other words, the area of the meshing area 6*p* on the side of the slide surface 6*a* is larger than the meshing area 6*q* on the side of the non-slide surface 6*b* only by a degree corresponding to the bottom area of the bottomed groove 6*z*.

When the side plate 6 configured as described above is inserted with the slide surface 6*a* and the non-slide surface 6*b* reversed, the following situation occurs.

That is, if the slide surface 6*a* and the non-slide surface 6*b* of the side plate 6 are reversed, the area of the meshing area 6*q* that faces the portion corresponding to the meshing portion of the driving gear 2 and the driven gear 3 is smaller than the area of the meshing area 6*p* when the side plate 6 is inserted in the correct direction. Therefore, during operation of the gear pump, the amount of hydraulic fluid that leaks from the discharge port Y to the suction port X increases, and the flow rate efficiency decreases.

That is, according to the present embodiment, the configuration as described above makes it easy to discover that the side plate 6 is mounted reversely through the decrease in flow rate efficiency during a trial operation. Accordingly, such a gear pump can prevent problems that the gear pump is delivered with the side plate 6 mounted reversely, or after delivery, the decrease in slidability between the gears 2 and 3 and the side plate 6 results in damage or the strange noise generated from such a gear pump resonates with the vehicle body of the vehicle equipped with the gear pump and causes loud noise.

Next, the second embodiment of the invention will be described hereafter with reference to FIG. 4 and FIG. 5.

The gear pump of the present embodiment has the same configuration as that of the first embodiment described above except for the shape of the side plate which is as described below Parts corresponding to those in the first embodiment are denoted by the same names and reference numerals, and detailed descriptions thereof are omitted.

The side plate of the gear pump according to the present embodiment is disposed at two positions so as to be brought into contact with two side surfaces 2*a* and 3*a* of the driving gear 2 and the driven gear 3 for respectively sealing the side surfaces 2*a* and 3*a* of the driving gear 2 and the driven gear 3. Among the outer peripheral edges of the side plate 6, an edge 6*e* on the low pressure side (that is, the side of the suction port X) has a shape corresponding to the inner surface of the gear housing compartment 11*a*, as shown in FIG. 4, whereas an edge 6*f* on the high pressure side (that is, the side of the discharge port Y) has a shape as shown below. A part of the edge 6*f* on the side of the discharge port Y is provided with a protrusion 6*f*1 that is in contact with the gear housing compartment 11*a*. The edge 6*f* is configured to be opposed to the inner surface of the gear housing compartment 11*a* only by the protrusion 6*f*1 with a slight gap, and largely separated from the inner surface of the gear housing compartment 11*a* in other portions. Then, a circumferential length of the protrusion 6*f*1 is set shorter than one pitch of the gears 2 and 3.

Figure 4:
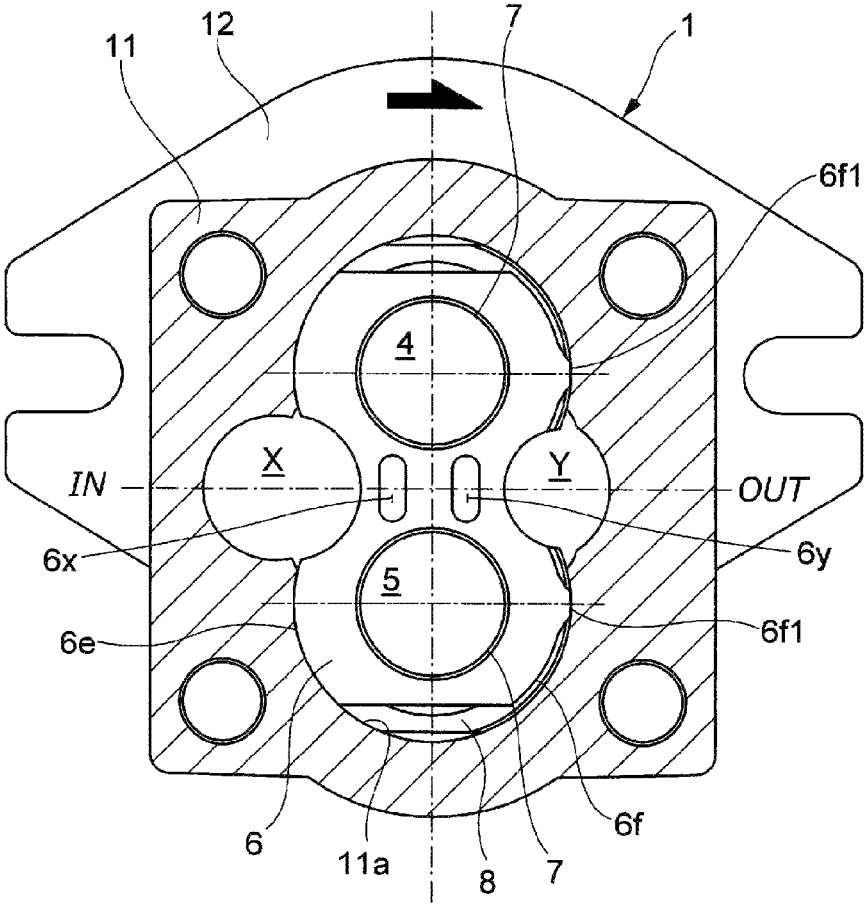
FIG. 4 is a cross-sectional view corresponding to FIG. 2 and showing the gear pump according to the second embodiment of the invention.
Figure 5:
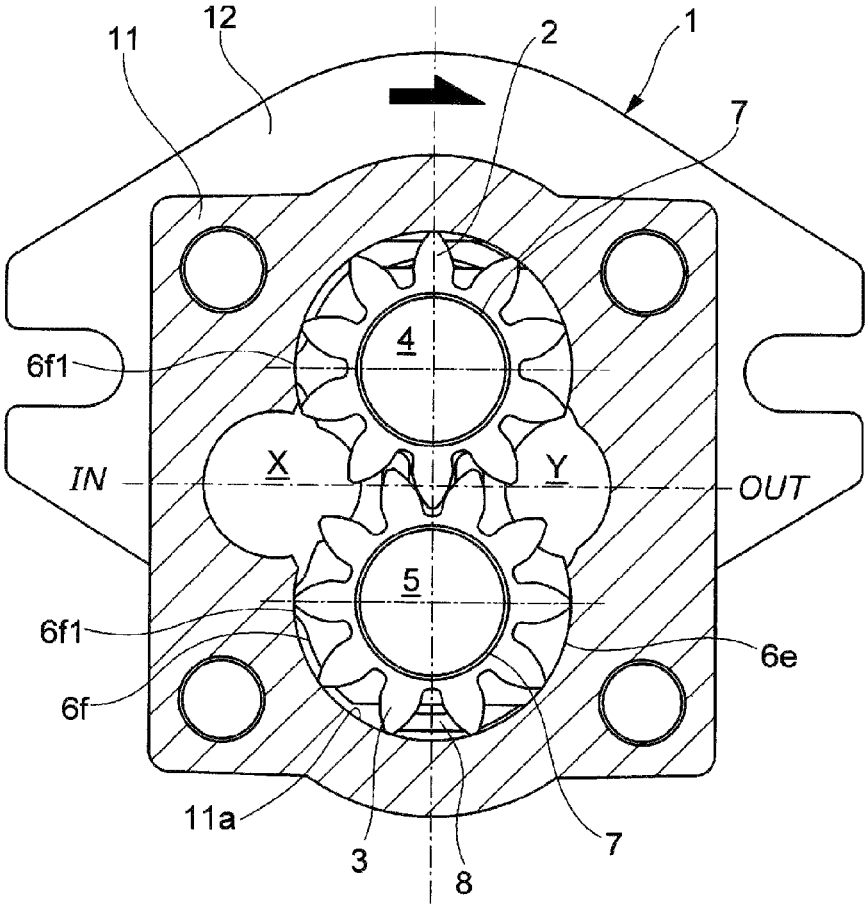
FIG. 5 is a cross-sectional view corresponding to FIG. 4 in a state where the high pressure side and the low pressure side of the side plate according to the embodiment are mounted reversely.
Figure 6:
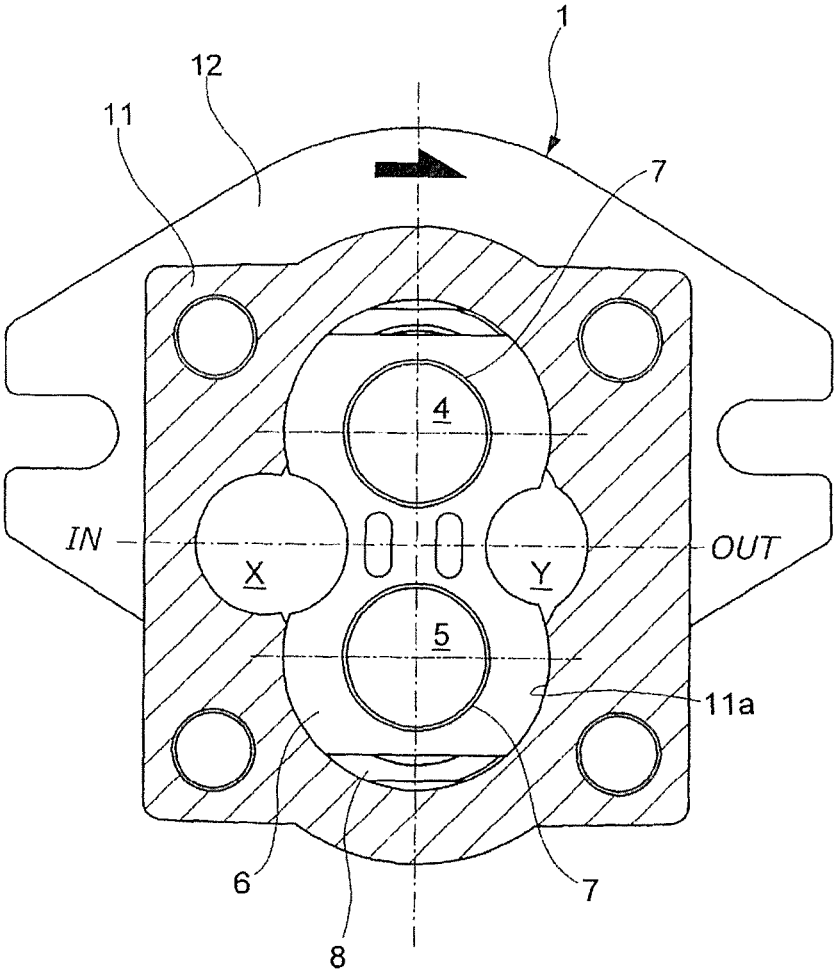
FIG. 6 (PRIOR ART)
FIG. 6 is a cross-sectional view corresponding to FIG. 2 and showing the conventional gear pump.

When the side plate 6 is mounted correctly, as shown in FIG. 4, the side plate 6 is pressed to the side of the suction port X by the force derived from the hydraulic fluid pressure, and the edge 6*e* on the side of the suction port X collides with the inner surface of the gear housing compartment 11*a* by the surface and prevents the hydraulic fluid from leaking to the side of the suction port X beyond the side plate 6.

Furthermore, if the gear pump operates in a state where the high pressure side and the low pressure side of the side plate 6 configured as described above are mounted reversely, the following situation occurs. That is, when the side plate 6 is pressed to the side of the suction port X by the force derived from the hydraulic fluid pressure, as shown in FIG. 5, the edge 6*f* located on the side of the suction port X collides with the inner surface of the gear housing compartment 11*a* only by the protrusion 6*f*1. In addition, the protrusion 6*f*1 is shorter than one pitch of the gear as described above. Therefore, when the space between the teeth of the gears 2 and 3 reaches a position facing the protrusion 6*f*1, the space filled with the hydraulic fluid of the high pressure side communicates with the low pressure side (the side of the suction port X) through the space between the teeth. Thereby, the flow rate efficiency during operation of the gear pump is decreased.

That is, according to the present embodiment, the configuration as described above makes it easy to discover that the high pressure side and the low pressure side of the side plate 6 are mounted reversely through the decrease in flow rate efficiency during a trial operation. Accordingly, such a gear pump can prevent problems that the gear pump is delivered with the high pressure side and the low pressure side of the side plate 6 mounted reversely, or after delivery, the strange noise generated from the gear pump resonates with the vehicle body of the vehicle equipped with the gear pump or motor and causes loud noise.

Nevertheless, the invention is not limited to the embodiments described above.

For example, the configurations of the features of the first and second embodiments described above may be applied to the same side plate. That is, a bottomed groove that opens on the side of the non-slide surface of the side plate may be provided, and a part of the edge on the high pressure side may be provided with a protrusion in contact with the gear housing compartment and the circumferential length of the protrusion may be set shorter than one pitch of the gear.

In addition, the configuration for facilitating discovery of the side plate being mounted reversely through the decrease in flow rate efficiency is not limited to the configuration of the first embodiment described above. However, according to the configuration of the first embodiment, by making the area of the meshing area that faces the portion corresponding to the meshing portion of the driving gear and the driven gear smaller than the area of the meshing area when the side plate is inserted in the correct direction, as described above, a difference in flow rate efficiency depending on the direction of the side plate can be generated effectively with a simple configuration.

Furthermore, the configuration for facilitating discovery of the high pressure side and the low pressure side of the side plate being mounted reversely through the decrease in flow rate efficiency is not limited to the configuration of the second embodiment described above. However, according to the configuration of the second embodiment, as described above, the length of the protrusion of the edge to be disposed on the high pressure side is made shorter than one pitch of the gear when the high pressure side and the low pressure side of the side plate are mounted reversely, so that if the edge and the protrusion are disposed on the low pressure side, the flow rate efficiency is greatly decreased. Therefore, this can also effectively generate a difference in flow rate efficiency depending on the direction of the side plate with a simple configuration.

In addition, various changes may be made without departing from the spirit of the invention.

What is claimed is:

1. A gear pump or motor, comprising:

a casing having a gear housing compartment inside, which houses a pair of gears;

a side plate interposed between the casing and the gears; and a gasket provided on a non-slide surface, which is a surface on an opposite side of a slide surface that is a surface on a side of the side plate facing the gears, and the gasket dividing a space between the non-slide surface and the casing into a high pressure side and a low pressure side, wherein a meshing area is provided on the side plate, between the low pressure side and the high pressure side, and corresponding to a position where the pair of gears mesh together, wherein the meshing area is larger on the slide surface than on the non-slide surface.

2. A gear pump or motor, comprising:

a casing having a gear housing compartment inside, which houses a pair of gears;

a side plate interposed between the casing and the gears; and a gasket provided on a non-slide surface, which is a surface on an opposite side of a slide surface that is a surface on a side of the side plate facing the gears, and the gasket dividing a space between the non-slide surface and the casing into a high pressure side and a low pressure side, wherein the side plate has at least one protrusion that is in contact with the gear housing compartment and provided on the side of the side plate, wherein the at least one protrusion is disposed on the high pressure side, and the side plate is configured to contact the gear housing compartment only by the at least one protrusion on the side plate, wherein each of the at least one protrusion is shorter than one pitch of the gears.

* * * * *